US009626931B2

(12) United States Patent
Kim et al.

(10) Patent No.: US 9,626,931 B2
(45) Date of Patent: Apr. 18, 2017

(54) DISPLAY DEVICE

(71) Applicant: Samsung Display Co., Ltd., Yongin-si, Gyeonggi-Do (KR)

(72) Inventors: Kyunho Kim, Cheonan-si (KR); Shimho Yi, Seoul (KR); Jieun Jang, Cheonan-si (KR); Sungin Kang, Hwaseong-si (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 63 days.

(21) Appl. No.: 14/817,768

(22) Filed: Aug. 4, 2015

(65) Prior Publication Data

US 2016/0196795 A1 Jul. 7, 2016

(30) Foreign Application Priority Data

Jan. 6, 2015 (KR) ..... 10-2015-0001248

(51) Int. Cl.
*G09G 3/36* (2006.01)

(52) U.S. Cl.
CPC ..... *G09G 3/3696* (2013.01); *G09G 3/3648* (2013.01); *G09G 2300/0413* (2013.01); *G09G 2310/0281* (2013.01); *G09G 2320/0223* (2013.01); *G09G 2330/021* (2013.01); *G09G 2330/08* (2013.01)

(58) Field of Classification Search
CPC ..... G09G 2330/021; G09G 3/3648; G09G 3/3696; G09G 2310/0281; G09G 2330/08; G09G 2320/0223; G09G 2300/0413
See application file for complete search history.

(56) References Cited

U.S. PATENT DOCUMENTS

| | | | | |
|---|---|---|---|---|
| 8,144,114 | B2 | 3/2012 | Jeon et al. | |
| 8,581,820 | B2 | 11/2013 | Woo et al. | |
| 8,743,107 | B2 | 6/2014 | Kim | |
| 2004/0046724 | A1* | 3/2004 | Woo | G09G 3/3614 345/87 |

(Continued)

FOREIGN PATENT DOCUMENTS

| | | | |
|---|---|---|---|
| KR | 10-2004-0021966 | A | 3/2004 |
| KR | 10-2006-0012801 | A | 2/2006 |

(Continued)

*Primary Examiner* — Charles Hicks
(74) *Attorney, Agent, or Firm* — Robert E. Bushnell, Esq.

(57) ABSTRACT

A display device is capable of preventing damage to a driver integrated circuit (IC) when a malfunction occurs therein, the display device including a display panel including a gate line, a data line, a first dummy line, and a second dummy line; a first data driver integrated circuit connected to one side of the data line; a second data driver integrated circuit connected to another side of the data line; a first power supply configured to apply a part of first enable signals to the first data driver integrated circuit, and to apply a part of second enable signals to the second data driver integrated circuit through the second dummy line; and a second power supply configured to apply the rest of the second enable signals to the second data driver integrated circuit, and to apply the rest of the first enable signals to the first data driver integrated circuit through the first dummy line.

16 Claims, 3 Drawing Sheets

(56) References Cited

U.S. PATENT DOCUMENTS

| | | | | |
|---|---|---|---|---|
| 2008/0074567 | A1* | 3/2008 | Jeon | G02F 1/1345 349/33 |
| 2011/0148852 | A1* | 6/2011 | Kim | G09G 3/20 345/213 |

FOREIGN PATENT DOCUMENTS

| | | | |
|---|---|---|---|
| KR | 10-2008-0028079 | A | 3/2008 |
| KR | 10-2011-0070094 | A | 6/2011 |

* cited by examiner

DISPLAY DEVICE

CLAIM OF PRIORITY

This application claims the priority of and all the benefits accruing under 35 U.S.C. §119 of Korean Patent Application No. 10-2015-0001248, filed on Jan. 6, 2015, with the Korean Intellectual Property Office (KIPO), the disclosure of which is incorporated herein in its entirety by reference.

BACKGROUND OF THE INVENTION

1. Field of Disclosure

Embodiments of the present invention relate to a display device capable of preventing damage to a driver integrated circuit (IC) when a malfunction occurs therein.

2. Description of the Related Art

As display devices are becoming larger in size, the length of data lines may increase as well. Accordingly, resistance and capacitance of the data line may also increase, which may cause distortion of image data signals applied to the data line.

In this regard, large-size display devices generally include a first data driver integrated circuit that applies an image data signal to a side of the data line and a second data driver integrated circuit that applies an image data signal to another side thereof.

However, in a case where a malfunction occurs and the first data driver integrated circuit does not operate properly, the data line may be operated only by the second data driver integrated circuit. Accordingly, the second data driver integrated circuit may be overloaded and damaged.

It is to be understood that this background of the technology section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY OF THE INVENTION

Aspects of embodiments of the present invention are directed to a display device capable of preventing damage to a data driver integrated circuit.

According to an exemplary embodiment, a display device includes a display panel including a gate line, a data line, a first dummy line, and a second dummy line; a first data driver integrated circuit connected to one side of the data line; a second data driver integrated circuit connected to another side of the data line; a first power supply configured to apply a part of first enable signals to the first data driver integrated circuit, and to apply a part of second enable signals to the second data driver integrated circuit through the second dummy line; and a second power supply configured to apply the rest of the second enable signals to the second data driver integrated circuit, and to apply the rest of the first enable signals to the first data driver integrated circuit through the first dummy line.

The first and second dummy lines may be parallel to the data line.

The display device may further include a first carrier mounted with the first data driver integrated circuit, the first data driver integrated circuit being connected to the first dummy line through a dummy terminal of the first carrier.

The display device may further include a second carrier mounted with the second data driver integrated circuit, the second data driver integrated circuit being connected to the second dummy line through a dummy terminal of the second carrier.

The display device may further include a first control printed circuit board mounted with the first power supply; and a first source printed circuit board, one side of the first source printed circuit board being connected to the first control printed circuit board and another side thereof being connected to the first data driver integrated circuit.

The display device may further include a second control printed circuit board mounted with the second power supply; and a second source printed circuit board, one side of the second source printed circuit board being connected to the second control printed circuit board and another side thereof being connected to the second data driver integrated circuit.

The first enable signals may include a plurality of driving voltages having different voltage levels.

The second power supply may apply a driving voltage of the plurality of driving voltages to the first data driver integrated circuit through the first dummy line.

The applied driving voltage may have a smallest voltage level of those of the plurality of driving voltages.

The second power supply may apply, to the second data driver integrated circuit, the rest of the driving voltages except for the applied driving voltage.

The second enable signals may include a plurality of driving voltages having different voltage levels.

The first power supply may apply a driving voltage of the plurality of driving voltages to the second data driver integrated circuit through the second dummy line.

The applied driving voltage may have a smallest voltage level of those of the plurality of driving voltages.

The first power supply may apply, to the first data driver integrated circuit, the rest of the driving voltages, except for the applied driving voltage.

The gate line and the data line may intersect each other.

According to an exemplary embodiment, a display device includes a display panel comprising a gate line and a data line; a first data driver integrated circuit and a second data driver integrated circuit, both connected to and driving the data line; first power supply connected to both the first and second data driver integrated circuits; and second power supply supplying an enable signal voltage of a same polarity as the first power supply, connected to both the first and second data driver integrated circuits; wherein the first data driver integrated circuit is enabled by both the first and second power supplies, the second data driver integrated circuit being is enabled by both the first and second power supplies.

According to embodiments of the present invention, a display device may have the following effects.

First, when one of a first power supply and a second power supply does not operate properly, damage to first data driver integrated circuits and second data driver integrated circuits, which is caused by overload, may be prevented.

Second, the first data driver integrated circuit and the second data driver integrated circuit may always start operation simultaneously.

Third, when a certain data carrier may not transmit a signal due to poor connection, the location of the data carrier may be precisely identified.

The foregoing is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
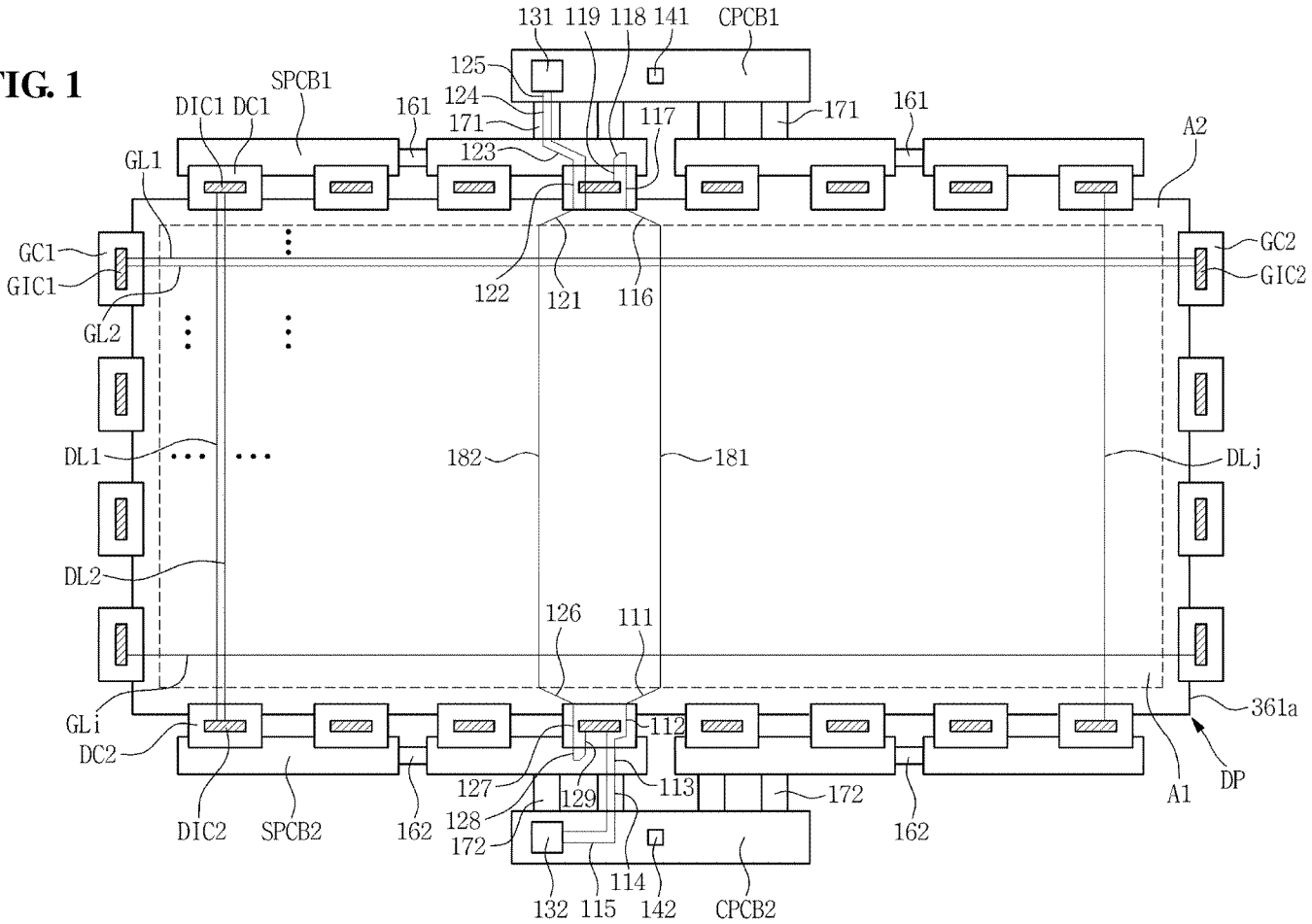
FIG. 1 is a view illustrating a display device according to an exemplary embodiment.

Advantages and features of the present invention and methods for achieving them will be made clear from embodiments described below in detail with reference to the accompanying drawings. The present invention may, however, be embodied in many different forms and should not be construed as being limited to the embodiments set forth herein. Rather, these embodiments are provided so that this disclosure will be thorough and complete, and will fully convey the scope of the invention to those skilled in the art. The present invention is merely defined by the scope of the claims. Therefore, well-known constituent elements, operations and techniques are not described in detail in the embodiments in order to prevent the present invention from being obscurely interpreted. Like reference numerals refer to like elements throughout the specification.

In the drawings, thicknesses are illustrated in an enlarged manner in order to clearly describe a plurality of layers and areas. Like reference numbers are used to denote like elements throughout the specification. When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The spatially related terms "below", "beneath", "lower", "above", "upper", and the like, may be used herein for ease of description to describe the relations between one element or component and another element or component as illustrated in the drawings. It will be understood that the spatially related terms are intended to encompass different orientations of the device in use or operation, in addition to the orientation depicted in the drawings. For example, in a case where a device shown in the drawing is turned over, the device positioned "below" or "beneath" another device may be placed "above" another device. Accordingly, the illustrative term "below" may include both the lower and upper positions. The device may also be oriented in the other direction, and thus the spatially related terms may be interpreted differently depending on the orientations.

Throughout the specification, when an element is referred to as being "connected" to another element, the element is "directly connected" to the other element, or "electrically connected" to the other element with one or more intervening elements interposed therebetween. It will be further understood that the terms "comprises", "comprising", "includes" and/or "including", when used in this specification, specify the presence of stated features, integers, steps, operations, elements, and/or components, but do not preclude the presence or addition of one or more other features, integers, steps, operations, elements, components, and/or groups thereof.

It will be understood that, although the terms "first", "second", "third", and the like may be used herein to describe various elements, these elements should not be limited by these terms. These terms are only used to distinguish one element from another element. Thus, "a first element" discussed below could be termed "a second element" or "a third element", and "a second element" and "a third element" can be termed likewise without departing from the teachings herein.

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present specification.

Figure 2:
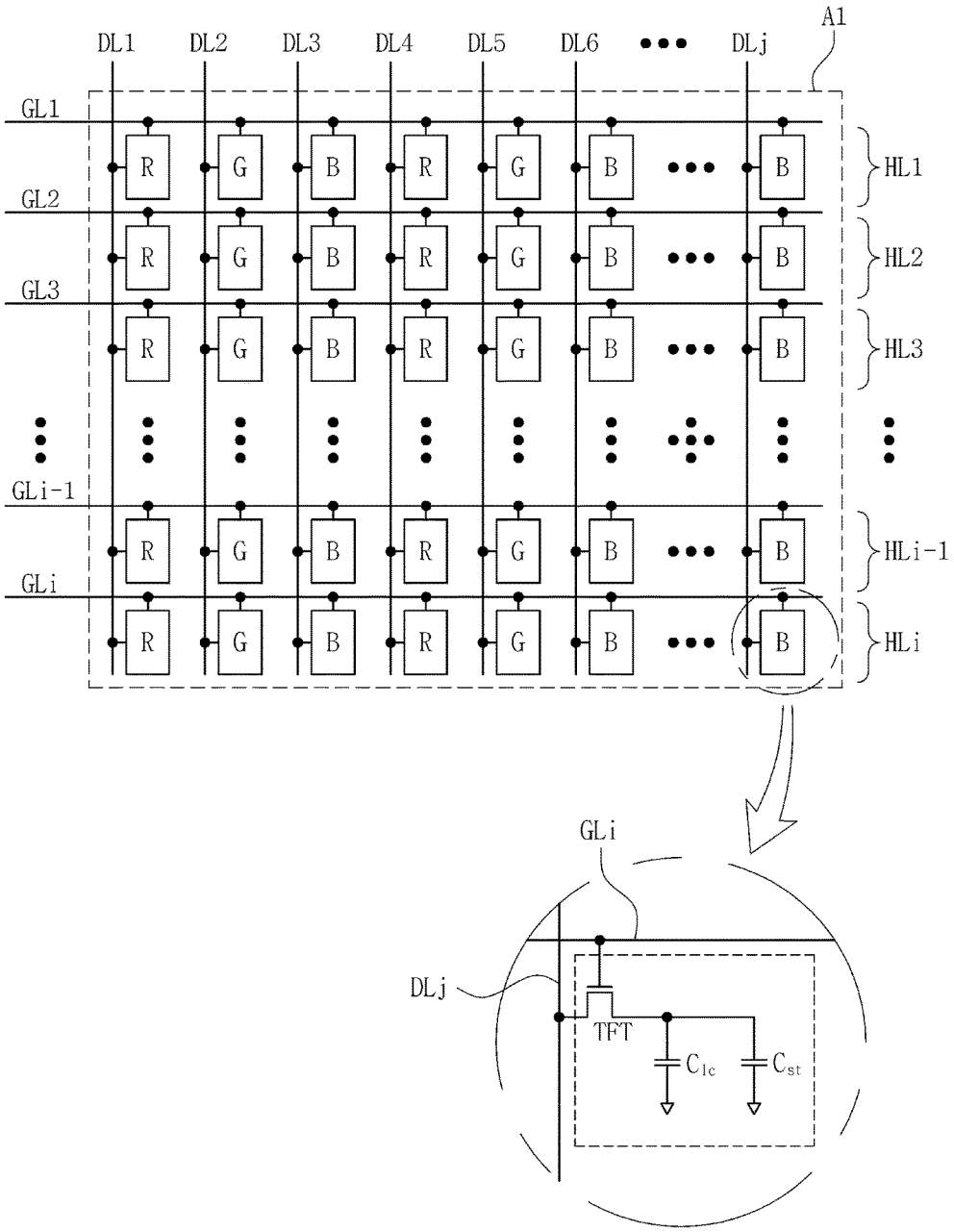
FIG. 2 is a view illustrating arrangement of pixels disposed in a display area of FIG. 1.

FIG. 1 is a view illustrating a display device according to an exemplary embodiment. FIG. 2 is a view illustrating arrangement of pixels disposed on a display area of FIG. 1.

According to an exemplary embodiment, as illustrated in FIG. 1, a display device includes a display panel DP, first gate driver integrated circuits GIC1, second gate driver integrated circuits GIC2, first data driver integrated circuits DIC1, second data driver integrated circuits DIC2, first source printed circuit boards SPCB1, second source printed circuit boards SPCB2, a first control printed circuit board CPCB1, a second control printed circuit board CPCB2, a first power supply 131, a second power supply 132, a first timing controller 141, and a second timing controller 142.

The display panel DP may include a lower substrate 361*a* and an upper substrate 361*b* (refer to FIG. 3) that face each other with a liquid crystal layer 555 (refer to FIG. 3) interposed therebetween.

The lower substrate 361*a* , as illustrated in FIG. 1, may be divided into a display area A1 and a non-display area A2. In the display area A1, as illustrated in FIG. 2, the followings are disposed a plurality of gate lines GL1 through GLi, a plurality of data lines DL1 through DLj intersecting the gate lines GL1 through GLi, at least one first dummy line 181, at least one second dummy line 182, and a plurality of pixels R, G, and B connected to the gate lines GL1 through GLi and the data lines DL1 through DLj.

The upper substrate 361*b* may be disposed on the lower substrate 361*a*. The upper substrate 361*b* may have a size that may at least cover an entire surface of the display area A1 of the lower substrate 361*a*.

The upper substrate 361*b* and the lower substrate 361*a* may each have a plurality of surfaces. For ease of description, the plurality of surfaces of the upper substrate 361*b* and the lower substrate 361*a* will be defined as follows. Surfaces facing each other with the liquid crystal layer 555 interposed therebetween are respectively defined as a front surface of the corresponding substrate and surfaces disposed opposite to the front surface are defined as a rear surface thereof.

Although not illustrated, a black matrix 342 (refer to FIG. 3), a plurality of color filters 366 (refer to FIG. 3), and a common electrode (not shown) may be disposed on the front surface of the upper substrate 361*b*.

The black matrix 342 may be disposed on a part of the front surface, apart from areas corresponding to pixel regions.

The color filters 366 may be disposed in the pixel region. The color filters 366 may be classified into a red color filter, a green color filter, and a blue color filter.

Pixels R, G, and B may be arranged in a matrix form in the display area A1. The pixels R, G, and B are classified into red pixels R disposed corresponding to the red color filter, green pixels G disposed corresponding to the green color filter, and blue pixels B disposed corresponding to the blue color filter. In this case, the red, green, and blue pixels R, G, and B adjacently disposed in a horizontal direction may form a unit pixel to display a unit image.

There are j pixels arranged along an $n^{th}$ (n is a number selected from 1 to i) horizontal line (hereinafter, $n^{th}$ horizontal line pixels) respectively connected to the first through the $j^{th}$ data lines DL1 through DLj. Further, the $n^{th}$ horizontal line pixels may be connected to the $n^{th}$ gate line together. Accordingly, the $n^{th}$ horizontal line pixels may receive an $n^{th}$ gate signal together. That is, j pixels arranged in the same horizontal line may receive the same gate signal, while pixels arranged in different horizontal lines may receive different gate signals. For example, red, green, and blue pixels R, G, and B disposed on the first horizontal line HL1 may receive a first gate signal, while red, green, and blue pixels R, G, and B disposed on the second horizontal line HL2 may receive a second gate signal that has a different timing compared to the first gate signal.

Each of the pixels R, G, and B, as illustrated in FIG. 2, may include a thin film transistor (TFT), a liquid crystal capacitor Clc, and a storage capacitor Cst.

The TFT may be turned on according to a gate signal applied from the gate line GLi. The turned-on TFT may supply an analog image data signal applied from the data line DLj to the liquid crystal capacitor Clc and the storage capacitor Cst.

The liquid crystal capacitor Clc may include a pixel electrode and a common electrode, which are disposed being opposed to each other.

The storage capacitor Cst may include a pixel electrode and an opposing electrode, which are disposed being opposed to each other. Herein, the opposing electrode may be a previous gate line or a common line that may transmit a common voltage.

The first gate driver integrated circuits GIC1 may be connected to one side of the gate lines GL1 through GLi.

The first gate driver integrated circuits GIC1 may output gate signals. The gate signals output from the first gate driver integrated circuits GIC1 may be supplied to one side of the gate lines GL1 through GLi. In this case, the gate signals output from the first gate driver integrated circuits GIC1 may be sequentially applied to the gate lines GL1 through GLi.

The first gate driver integrated circuit GIC1 may be mounted on a first gate carrier GC1. The first gate driver integrated circuit GIC1 may receive required signals through an input terminal (not shown) of the first gate carrier GC1 and may output the gate signals through an output terminal of the first gate carrier GC1.

The first gate carrier GC1 may be manufactured into a tape or film form.

The first gate carrier GC1 may include a plurality of inside signal lines (not shown). One end portion of each of the inside signal lines is an input terminal (not shown) and another end portion of the respective inside signal lines is a transmission terminal. The inside signal lines of the first gate carriers GC1 adjacent to each other are connected to each other by signal lines disposed in the non-display area. That is, a transmission terminal of one of the first gate carriers GC1 and an input terminal (not shown) of another first gate carrier GC1 adjacent thereto may be connected to each other by a signal line disposed therebetween. Meanwhile, inside signal lines of an uppermost first gate carrier of the first gate carriers GC1 may be connected to signal lines disposed at an upper left corner of the non-display area. In other words, each input terminal (not shown) of the inside signal lines may be connected to the signal lines disposed at the upper left corner. The signal lines at the upper left corner may be connected to the first timing controller 141 and the first power supply 131 through signal lines disposed on a leftmost first data carrier DC1, signal lines disposed on two first source printed circuit boards SPCB1 disposed adjacent to the left side, and signal lines disposed on the first control printed circuit board CPCB1. Accordingly, signals output from the first timing controller 141 and the first power supply 131 may be transmitted to the inside signal lines of the first gate carrier GC1.

Meanwhile, inside signal lines of a lowermost first gate carrier GC1 of the first gate carriers GC1 may be connected to signal lines disposed at a lower left corner of the non-display area A2. In other words, each input terminal (not shown) of the inside signal lines may be connected to the signal lines at the lower left corner. The signal lines at the lower left corner may be connected to the second timing controller 142 and the second power supply 132 through signal lines disposed on a leftmost second data carrier DC2, signal lines disposed on two second source printed circuit boards SPCB2 disposed adjacent to the left side, and signal lines disposed on the second control printed circuit board CPCB2. Accordingly, signals output from the second timing controller 142 and the second power supply 132 may be transmitted to the inside signal lines of the first gate carriers GC1.

The first gate driver integrated circuit GIC1 may be connected to the inside signal lines of the first gate carrier GC1. The first gate driver integrated circuit GIC1 may generate gate signals using signals applied from the inside signal lines. The first gate driver integrated circuit GIC1 may output gate signals through the output terminals of the first gate carrier GC1. The output terminals of the first gate driver integrated circuit GIC1 may be connected to one side of the gate lines through a first gate pad unit disposed in the non-display area.

The output terminals of the first gate carrier GC1 and the first gate pad unit may be attached to each other by an anisotropic conductive bonding film.

The first gate carrier GC1 may include flexible materials that are bendable. For example, the first gate carrier GC1 may be formed of polyimide having a high coefficient of thermal expansion (CTE) and excellent durability. Apart from the polyimide, a synthetic resin, such as acrylic, polyether nitrile, polyethersulfone, polyethylene terephthalate, and polyethylenenaphthalate, may be used to form the first gate carrier GC1.

The second gate driver integrated circuit GIC2 may be connected to another side of the gate lines.

The second gate driver integrated circuits GIC2 may output gate signals. The gate signals output from the second gate driver integrated circuits GIC2 may be applied to another side of the gate lines. In this case, the gate signals output from the second gate driver integrated circuits GIC2 may be sequentially applied to the gate lines GL1 through GLi.

The gate signals output from the second gate driver integrated circuits GIC2 may be identical to the gate signals output from the first gate driver integrated circuits GIC1. Accordingly, as for a single gate line, a gate signal applied to one end portion of the gate line and a gate signal applied to another end portion thereof may be identical to each other.

The second gate driver integrated circuit GIC2 may be mounted on the second gate carrier GC2. The second gate driver integrated circuit GIC2 may receive required signals through an input terminal (not shown) of the second gate carrier GC2 and may output the aforementioned gate signals through an output terminal of the second gate carrier GC2.

The second gate carrier GC2 may be manufactured into a tape or film form.

The second gate carrier GC2 may include a plurality of inside signal lines. One end portion of each of the inside signal lines (not shown) is an input terminal (not shown) and another end portion of each of the inside signal lines is a transmission terminal. The inside signal lines of the second gate carriers GC2 adjacent to each other are connected to each other by signal lines disposed in the non-display area A2. That is, a transmission terminal of one of the second gate carriers GC2 and an input terminal (not shown) of another second gate carrier GC2 adjacent thereto may be connected to each other by a signal line disposed therebetween. Meanwhile, inside signal lines of an uppermost second gate carrier GC2 of the second gate carriers GC2 may be connected to signal lines disposed at an upper right corner of the non-display area A2. In other words, each input terminal of the inside signal lines may be connected to the signal lines at the upper right corner. The signal lines at the upper right corner may be connected to the first timing controller 141 and the first power supply 131 through signal lines disposed on a rightmost first data carrier DC1, signal lines disposed on two first source printed circuit boards SPCB1 disposed adjacent to the right side, and signal lines disposed on the first control printed circuit board CPCB1. Accordingly, signals output from the first timing controller 141 and the first power supply 131 may be transmitted to the inside signal lines of the second gate carrier GC2.

Meanwhile, inside signal lines of a lowermost second gate carrier GC2 of the second gate carriers GC2 may be connected to signal lines disposed at a lower right corner of the non-display area A2. In other words, each input terminal of the inside signal lines may be connected to the signal lines at the lower right corner. The signal lines at the lower right corner may be connected to the second timing controller 142 and the second power supply 132 through signal lines disposed on a rightmost second data carrier DC2, signal lines disposed on two second source printed circuit boards SPCB2 disposed adjacent to the right side, and signal lines disposed on the second control printed circuit board CPCB2. Accordingly, signals output from the second timing controller 142 and the second power supply 132 may be transmitted to the inside signal lines of the second gate carrier GC2.

The second gate driver integrated circuit GIC2 may be connected to the inside signal lines of the second gate carrier GC2. The second gate driver integrated circuit GIC2 may generate gate signals, using signals applied from the inside signal lines. The second gate driver integrated circuit GIC2 may output gate signals through the output terminals of the second gate carrier GC2. The output terminals of the second gate driver integrated circuit GIC2 may be connected to another side of the gate lines GL through a second gate pad unit disposed in the non-display area A2.

The output terminals of the second gate carrier GC2 and the second gate pad unit may be bonded to each other by an anisotropic conductive bonding film.

The second gate carrier GC2 may include flexible materials that are bendable. For example, the second gate carrier GC2 may be formed of the aforementioned synthetic resin, such as polyimide, acrylic, polyether nitrile, polyethersulfone, polyethylene terephthalate, and polyethylenenaphthalate.

The first data driver integrated circuits DIC1 may be connected to one side of the data lines DL1 through DLj.

The first data driver integrated circuit DIC1 may output image data signals. The image data signals output from the first data driver integrated circuit DIC1 may be applied to one side of the data lines. In this case, the image data signals output from the first data driver integrated circuits DIC1 may be simultaneously applied to all of the data lines DL1 through DLj.

The first data driver integrated circuit DIC1 may be mounted on the first data carrier DC1. The first data driver integrated circuit DIC1 may receive required signals through an input terminal (not shown) of the first data carrier DC1 and output the image data signals through an output terminal of the first data carrier DC1.

The first data carrier DC1 may be manufactured into a tape or film form.

The first data carriers DC1 may electrically connect the first source printed circuit boards SPCB1 and the display panel DP. To this end, for example, the input terminals of the first data carrier DC1 may be connected to a pad unit of the first source printed circuit board SPCB1 and the output terminals of the first data carrier DC1 may be connected to a first data pad unit disposed in the non-display area A2 of the display panel DP. The first data pad unit may be connected to one side of the data lines DL1 through DLj.

The input terminals of the first data carriers DC1 and the pad unit of the first source printed circuit boards SPCB1 may be attached to each other by the anisotropic conductive bonding film. Further, the output terminals of the first data carriers DC1 and the first data pad unit may be attached to each other by an anisotropic conductive bonding film.

The first data carrier DC1 may include flexible materials that are bendable. For example, the first data carriers DC1 may be formed of the aforementioned synthetic resin, such as polyimide, acrylic, polyether nitrile, polyethersulfone, polyethylene terephthalate, and polyethylenenaphthalate.

Two first source printed circuit boards SPCB1 disposed adjacent to the left side, among the four first source printed circuit boards SPCB 1, may be electrically connected to each other by a flexible printed circuit 161. Further, two first source printed circuit boards SPCB1 disposed adjacent to the right side, among the four first source printed circuit boards SPCB1, may be electrically connected to each other by a flexible printed circuit 161.

The first control printed circuit board CPCB1 may be electrically connected to two first source printed circuit boards SPCB1 by flexible printed circuit boards 171.

The first timing controller 141 and the first power supply 131 may be mounted on the first control printed circuit board CPCB 1.

The first timing controller 141 is configured to receive a vertical synchronization signal Vsync, a horizontal synchronization signal Hsync, an image data signal DATA, and a clock signal DCLK output from a graphic controller provided in a system. A first interface circuit may be provided between the first timing controller 141 and the system, and the signals output from the system may be input to the first timing controller 141 through the first interface circuit. The first interface circuit may be equipped inside the first timing controller 141.

Although not illustrated, the first interface circuit may include a low voltage differential swing (LVDS) receiver. The first interface circuit may decrease voltage levels of the vertical synchronization signal Vsync, the horizontal synchronization signal Hsync, the image data signal DATA, and the clock signal DCLK output from the system, but may increase frequencies thereof.

Meanwhile, due to a high-frequency component of the signal input from the first interface circuit to the first timing controller 141, electromagnetic interference (EMI) may be caused therebetween. In order to prevent the interference, an EMI filter (not illustrated) may be further provided between the first interface circuit and the first timing controller 141.

The first timing controller 141 may generate a gate control signal for controlling the first gate driver integrated circuits GIC1 and the second gate driver integrated circuits GIC2 and a data control signal for controlling the first data driver integrated circuits DIC1, using the vertical synchronization signal Vsync, the horizontal synchronization signal Hsync, and the clock signal DCLK. The gate control signal may include a gate start pulse, a gate shift clock, a gate output enable signal, and the like. The data control signal may include a source start pulse, a source shift clock, a source output enable signal, a polarity signal, and the like.

Further, the first timing controller 141 may rearrange the image data signals DATA input through the system and supply the rearranged image data signals DATA' to the first data driver integrated circuits DIC1.

Meanwhile, the first timing controller 141 is operated by a driving power output from a power unit provided in the system. In particular, the driving power may be used as a power voltage of a phase lock loop PLL equipped inside the first timing controller 141. The phase lock loop PLL may compare the clock signal DCLK input to the first timing controller 141 with a reference frequency generated by an oscillator. In a case where there is a difference between the compared values, the phase lock loop PPL may adjust the frequency of the clock signal by the difference to thereby produce a sampling clock signal. The sampling clock signal is a signal used to perform sampling of the image data signals DATA'.

The first power supply 131 may increase or decrease the driving power input through the system to thereby generate voltages required for the display panel DP. To this end, the first power supply 131 may include, for example, an output switching element for switching an output voltage of an output terminal thereof; and a pulse width modulator PWM for adjusting a duty ratio or a frequency of a control signal applied to a control terminal of the output switching element to increase or decrease the output voltage. Herein, the first power supply 131 may include a pulse frequency modulator PFM, in lieu of the pulse width modulator PWM.

The pulse width modulator PWM may increase the duty ratio of the aforementioned control signal to increase the output voltage of the first power supply 131 or decrease the duty ratio of the control signal to decrease the output voltage of the first power supply 131. The pulse frequency modulator PFM may increase the frequency of the aforementioned control signal to increase the output voltage of the first power supply 131 or decrease the frequency of the control signal to decrease the output voltage of the first power supply 131.

The output voltage of the first power supply 131 may include a reference voltage VDD of more than or equal to about 6 [V], a gamma reference voltage GMA1-10 of less than level 10, a common voltage in a range of about 2.5 [V] to about 3.3 [V], a gate high voltage of more than or equal to about 15 [V], and a gate low voltage of less than or equal to about −4 [V], and first and second enable signals. Herein, the first enable signals may include a first driving voltage of about 1.2 [V], a second driving voltage of about 1.8 [V], and a third driving voltage of about 3.3 [V]. The second enable signals may also include a first driving voltage of about 1.2 [V], a second driving voltage of about 1.8 [V], and a third driving voltage of about 3.3 [V].

The gamma reference voltage GMA1-10 is a voltage generated by voltage division of the reference voltage. The reference voltage and the gamma reference voltage are analog gamma voltages, and they are provided to the first data driver integrated circuits DIC1. The common voltage may be applied to the common electrode of the display panel DP via the first data driver integrated circuit DIC1. A gate high voltage is a high logic voltage of the gate signal, which is set to be more than or equal to a threshold voltage of the TFT. Further, the gate low voltage is a low logic voltage of the gate signal, which is set to be an off voltage of the TFT. The gate high voltage and the gate low voltage may be applied to first gate driver integrated circuits GIC1 and the second gate driver integrated circuits GIC2.

The first gate driver integrated circuits GIC1 and the second gate driver integrated circuits GIC2 may generate gate signals according to the gate control signal applied from the first timing controller 141 and may sequentially apply the gate signals to the plurality of gate lines GL1 to GLi.

The first data driver integrated circuits DIC1 are configured to receive the image data signals DATA' and the data control signal DCS from the first timing controller 141. The first data driver integrated circuits DIC1 may perform sampling of the image data signals DATA' according to the data control signal DCS, may perform latching of the sampled image data signals corresponding to one horizontal line every horizontal period, and may apply the latched image data signals to the data lines DL1 through DLj. That is, the first data driver integrated circuit DIC1 may convert the image data signals DATA' applied from the first timing controller 141 into analog image data signals using the gamma reference voltages GMA1-10 input from the first power supply 131 and provide them to the data lines DL1 through DLj.

The second data driver integrated circuits DIC2 may be connected to another side of the data lines DL1 through DLj.

The second data driver integrated circuits DIC2 may output image data signals. The image data signals output from the second data driver integrated circuits DIC2 may be applied to another side of the data lines DL1 through DLj. In this case, the image data signals output from the second data driver integrated circuits DIC2 may be simultaneously applied to all of the data lines DL1 through DLj.

The image data signals output from the second data driver integrated circuits DIC2 may be identical to the image data signals output from the first data driver integrated circuits DIC1. Accordingly, as for a single data line, an image data signal applied to one side of the data line and an image data signal applied to another side thereof may be identical to each other.

The second data driver integrated circuit DIC2 may be mounted on the second data carrier DC2. The second data driver integrated circuit DIC2 may receive required signals through an input terminal (not shown) of the second data carrier DC2 and output the image data signals through an output terminal of the second data carrier DC2.

The second data carrier DC2 may be manufactured into a tape or film form.

The second data carriers DC2 may electrically connect the second source printed circuit boards SPCB2 and the display panel DP. To this end, for example, the input terminals of the second data carrier DC2 may be connected to a pad unit of the second source printed circuit board SPCB2 and the output terminals of the second data carrier DC2 may be connected to a second data pad unit disposed in the non-display area A2 of the display panel DP. The second data pad unit may be connected to another side of the data lines DL1 through DLj.

The input terminals of the second data carriers DC2 and the pad unit of the second source printed circuit boards SPCB2 may be attached to each other by an anisotropic conductive bonding film. Further, the output terminals of the second data carriers DC2 and the second data pad unit may be attached to each other by an anisotropic conductive bonding film.

The second data carrier DC2 may include flexible materials that are bendable. For example, the second data carrier DC2 may be formed of the aforementioned synthetic resin, such as polyimide, acrylic, polyether nitrile, polyethersulfone, polyethylene terephthalate, and polyethylenenaphthalate.

Two second source printed circuit boards SPCB2 disposed adjacent to the left side, among the four second source printed circuit boards SPCB2, may be electrically connected to each other by a flexible printed circuit 162. Further, two second source printed circuit boards SPCB2 disposed adjacent to the right side, among the four second source printed circuit boards SPCB2, may be electrically connected to each other by a flexible printed circuit 162.

The second control printed circuit board CPCB2 may be electrically connected to two second source printed circuit boards SPCB2 by flexible printed circuit boards 172.

The second timing controller 142 and the second power supply 132 may be mounted on the second control printed circuit board CPCB2.

The second timing controller 142 is configured to receive a vertical synchronization signal Vsync, a horizontal synchronization signal Hsync, an image data signal DATA, and a clock signal DCLK output from a graphic controller provided in a system. A second interface circuit may be provided between the second timing controller 142 and the system, and the signals output from the system may be input to the second timing controller 142 through the second interface circuit. The second interface circuit may be equipped inside the second timing controller 142.

Although not illustrated, the second interface circuit may include a low voltage differential swing (LVDS) receiver. The second interface circuit may decrease voltage levels of the vertical synchronization signal Vsync, the horizontal synchronization signal Hsync, the image data signal DATA, and the clock signal DCLK output from the system, but may increase frequencies thereof.

Meanwhile, an EMI filter may be further provided between the second interface circuit and the second timing controller 142.

The second timing controller 142 may generate a gate control signal for controlling the first and second gate driver integrated circuits GIC1 and GIC2 and a data control signal for controlling the second data driver integrated circuit DIC2, using the vertical synchronization signal Vsync, the horizontal synchronization signal Hsync, and the clock signal DCLK. The gate control signal may include a gate start pulse, a gate shift clock, a gate output enable signal, and the like. The data control signal may include a source start pulse, a source shift clock, a source output enable signal, a polarity signal, and the like.

Further, the second timing controller 142 may rearrange the image data signals DATA input through the system and supply the rearranged image data signals DATA' to the second data driver integrated circuits DIC2.

Meanwhile, the second timing controller 142 is operated by a driving power output from a power unit provided in the system. In particular, the driving power may be used as a power voltage of a phase lock loop PLL equipped inside the second timing controller 142. The phase lock loop PLL may compare the clock signal DCLK input to the second timing controller 142 with a reference frequency generated by an oscillator. In a case where there is a difference between the compared values, the phase lock loop PPL may adjust the frequency of the clock signal by the difference to thereby produce a sampling clock signal. The sampling clock signal may be used to perform sampling of the image data signals DATA'.

The second power supply 132 may increase or decrease the driving power input through the system to thereby generate voltages required for the display panel DP. To this end, the second power supply 132 may also include the aforementioned output switching element and the pulse width modulator PWM. Herein, the second power supply 132 may include a pulse frequency modulator PFM, in lieu of the pulse width modulator PWM.

The pulse width modulator PWM may increase the duty ratio of the aforementioned control signal to increase the output voltage of the second power supply 132 or decrease the duty ratio of the control signal to decrease the output voltage of the second power supply 132. The pulse frequency modulator PFM may increase the frequency of the aforementioned control signal to increase the output voltage of the second power supply 132 or decrease the frequency of the control signal to decrease the output voltage of the second power supply 132.

The output voltage of the second power supply 132 may include a reference voltage VDD of more than or equal to about 6 [V], a gamma reference voltage GMA1-10 of less than level 10, a common voltage in a range of about 2.5 [V] to about 3.3 [V], a gate high voltage of more than or equal to about 15 [V], and a gate low voltage of less than or equal to about −4 [V], and first and second enable signals. Herein, the first enable signals may include a first driving voltage of about 1.2 [V], a second driving voltage of about 1.8 [V], and a third driving voltage of about 3.3 [V]. The second enable signals may also include a first driving voltage of about 1.2 [V], a second driving voltage of about 1.8 [V], and a third driving voltage of about 3.3 [V].

The gamma reference voltage GMA1-10 is a voltage generated by voltage division of the reference voltage. The reference voltage and the gamma reference voltage are analog gamma voltages, and they are provided to the second data driver integrated circuits DIC2. The common voltage may be applied to a common electrode of the display panel DP via the second data driver integrated circuit DIC2. The gate high voltage is a high logic voltage of the gate signal, which is set to be more than or equal to a threshold voltage of the TFT. The gate low voltage is a low logic voltage of the gate signal, which is set to be an off voltage of the TFT. The gate high voltage and the gate low voltage may be applied to first gate driver integrated circuits GIC1 and the second gate driver integrated circuits GIC2.

The first gate driver integrated circuits GIC1 and the second gate driver integrated circuits GIC2 may generate gate signals according to the gate control signal GCS applied from the second timing controller 142 and may sequentially apply the gate signals to the gate lines GL1 to GLi.

The second data driver integrated circuits DIC2 are configured to receive the image data signals DATA' and the data control signal DCS from the second timing controller 142. The second data driver integrated circuits DIC2 may perform sampling of the image data signals DATA' according to the data control signal DCS, may perform latching of the sampled image data signals corresponding to one horizontal line every horizontal period, and may apply the latched image data signals to the data lines DL1 through DLj. That is, the second data driver integrated circuits DIC2 may convert the image data signals DATA' applied from the second timing controller 142 into analog image data signals, using the gamma reference voltages GMA1-10 input from the second power supply 132, and provide them to the data lines DL1 through DLj.

The first and second timing controllers 141 and 142 may operate in one of a master mode and a slave mode, according to an externally received mode control signal.

The first timing controller 141, when operated in the master mode, may control operation of the first data driver integrated circuits DIC1, the first gate driver integrated circuits GIC1, and the second gate driver integrated circuits GIC2. On the other hand, the first timing controller 141, when operated in the slave mode, may control operation of the first data driver integrated circuits DIC1. In other words, the first timing controller 141, when operated in the slave mode, may not play a role in operation of the first gate driver integrated circuits GIC1 and the second gate driver integrated circuit GIC2.

Further, the second timing controller 142, when operated in the master mode, may control operation of the second data driver integrated circuit DIC2, the first gate driver integrated circuits GIC1, and the second gate driver integrated circuit GIC2. On the other hand, the second timing controller 142, when operated in the slave mode, may control operation of the second data driver integrated circuit DIC2. In other words, the second timing controller 142, when operated in the slave mode, may not play a role in operation of the first gate driver integrated circuits GIC1 and the second gate driver integrated circuit GIC2.

In this case, the first and second timing controllers 141 and 142 may operate in a mode different from each other. In other words, when the first timing controller 141 operates in the master mode, the second timing controller 142 may operate in the slave mode. On the contrary, when the first timing controller 141 operates in the slave mode, the second timing controller 142 may operate in the master mode.

Meanwhile, the first data driver integrated circuit DIC1 may be operated by the first enable signals, and the second data driver integrated circuit DIC2 may be operated by the second enable signals. In a case where any one of the first enable signals is not applied to the first data driver integrated circuit DIC1, the first data driver integrated circuit DIC1 may not operate. Likewise, in a case where any one of the second enable signals is not applied to the second data driver integrated circuit DIC2, the second data driver integrated circuit DIC2 may not operate.

The first power supply 131 may apply a part of the first enable signals to the first data driver integrated circuit DIC1, and may apply a part of the second enable signals to the second data driver integrated circuit DIC2 through the second dummy line 182. For example, the first power supply 131 may apply the second driving voltage and the third driving voltage to the first data driver integrated circuit DIC1, and may apply the first driving voltage to the second data driver integrated circuit DIC2.

One side of the second dummy line 182 may be connected to the output terminal of the first power supply 131 through the following signal lines, i.e. a signal line 121 in the non-display area A2, a signal line 122 on the first data carrier DC1, a signal line 123 on the first source printed circuit board SPCB1, a signal line 124 on the flexible printed circuit board 171, and a signal line 125 on the first control printed circuit board CPCB1. Further, another side of the second dummy line 182 may be connected to the second data driver integrated circuit DIC2 through a signal line 126 in the non-display area A2, a signal line 127 on the second data carrier DC2, a signal line 128 on the second source printed circuit board SPCB2, and another signal line 129 on the second data carrier DC2. The second dummy line 182 and the signal lines 121 through 129 may transmit the first driving voltage output from the first power supply 131 to the second data driver integrated circuit DIC2. Herein, the signal line 122 on the first data carrier DC1 may be a dummy line of the signal lines of the first data carrier DC1 that remains unused. Further, the signal line 127 on the second data carrier DC2 may be a dummy line of the signal lines of the second data carrier DC2 that remains unused.

The second power supply 132 may apply the rest of the second enable signals to the second data driver integrated circuit DIC2, and may apply the rest of the first enable signals to the first data driver integrated circuit DIC1 through the first dummy line 181. For example, the second power supply 132 may apply the second driving voltage and the third driving voltage to the second data driver integrated circuit DIC2 and may apply the first driving voltage to the first data driver integrated circuit DIC1.

One side of the first dummy line 181 may be connected to the output terminal of the second power supply 132 through the following signal lines, i.e. a signal line 111 in the non-display area A2, a signal line 112 on the second data carrier DC2, a signal line 113 on the second source printed circuit board SPCB2, a signal line 114 on the flexible printed circuit board 172, and a signal line 115 on the second control printed circuit board CPCB2. Further, another side of the first dummy line 181 may be connected to the first data driver integrated circuit DIC1 through the following signal lines, i.e. a signal line 116 in the non-display area A2, a signal line 117 on the first data carrier DC1, a signal line 118 on the first source printed circuit board SPCB1, and another signal line 119 on the first data carrier DC1. The first dummy line 181 and the signal lines 111 through 119 may transmit the first driving voltage output from the second power supply 132 to the first data driver integrated circuit DIC1. Herein, the signal line 117 on the first data carrier DC1 may be a dummy line of the signal lines of the first data carrier DC1 that remains unused. Further, the signal line 112 on the second data carrier DC2 may be a dummy line of the signal lines of the second data carrier DC2 that remains unused.

Accordingly, the first data driver integrated circuit DIC1 may start operation by the second and third driving voltages applied from the first power supply 131 and the first driving voltage applied from the second power supply 132. Likewise, the second data driver integrated circuit DIC2 may start operation by the second and third driving voltages applied from the second power supply 132 and the first driving voltage applied from the first power supply 131.

Meanwhile, although not illustrated, all of the first data driver integrated circuits DIC1 may start operation by the driving voltages applied from the first power supply 131 and the second power supply 132 as described above; and all of the second data driver integrated circuits DIC2 may start operation by the driving voltages applied from the first power supply 131 and the second power supply 132 as described above. Provided that eight first data driver integrated circuits DIC1 and eight second data driver integrated circuits DIC2 are provided in the display device, as illustrated in FIG. 1, eight first dummy lines 181 and eight second dummy lines 182 may be required.

Accordingly, in a case where any one of the first power supply 131 and the second power supply 132 does not operate properly, all of the first data driver integrated circuits DIC1 and the second data driver integrated circuits DIC2 may not operate. Therefore, in a case where any one of the first power supply 131 and the second power supply 132 is out of order, damage to the first data driver integrated circuits DIC1 and the second data driver integrated circuits DIC2, which is caused by overload, may be prevented.

Further, only when both of the first power supply 131 and the second power supply 132 operate normally, all of the first data driver integrated circuits DIC1 and the second data driver integrated circuits DIC2 may operate. Accordingly, the first data driver integrated circuit DIC1 and the second data driver integrated circuit DIC2 may always start operation simultaneously. In other words, there is no time difference between an initial operation time point of the first data driver integrated circuit DIC1 and an initial operation time point of the second data driver integrated circuit DIC2.

Further, in a case where a connection defect occurs between a predetermined first data carrier DC1 and the first source printed circuit board SPCB1 and thus the predetremined first data carrier DC1 may not transmit a signal, although both of the first and second power supplies 131 and 132 operate normally, the first data driver integrated circuit DIC1 mounted on the predetermined first data carrier DC1 may not operate. In this case, the predetermined first data carrier DC1 may not be capable of transmitting an enable signal, and thus the second data driver integrated circuit DIC2 corresponding to the first data driver integrated circuit DIC1 may not receive the enable signal as well. Accordingly, in such a case, the second data driver integrated circuit DIC2 may not be overloaded, either. Further, in a case where a defect occurs in the predetermined first data carrier DC1 accordingly, a part of the display panel disposed between the predetermined first data carrier DC1 and the corresponding second data carrier DC2 may not display images normally, such that a user may precisely identify in which data carrier the defect occurs.

Accordingly, in a case where any one of the first power supply 131 and the second power supply 132 does not operate properly, all of the first data driver integrated circuits DIC1 and the second data driver integrated circuits DIC2 may not operate.

Meanwhile, although the first dummy line 181 may transmit any one of the first through third driving voltages, it is desirable to transmit the first driving voltage which has the smallest voltage level so as to minimize interference between the gate line and the data line. Likewise, although the second dummy line 182 may transmit any one of the first through third driving voltages, it is desirable to transmit the second driving voltage which has the smallest voltage level so as to minimize interference between the gate line GL and the data line DL.

Figure 3:
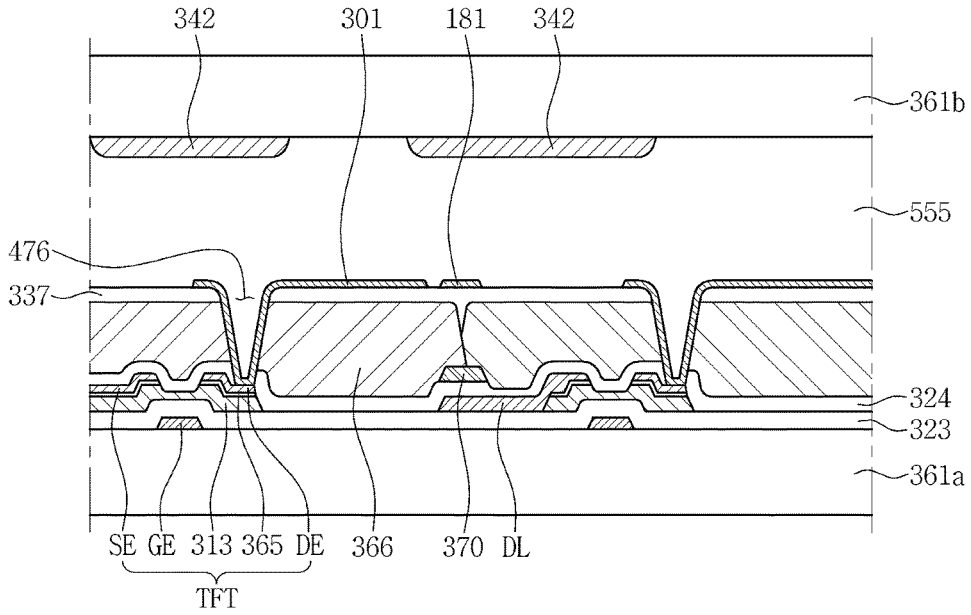
FIG. 3 is a cross-sectional view illustrating the position of a first dummy line of FIG. 1.

FIG. 3 is a cross-sectional view illustrating the position of the first dummy line 181 illustrated in FIG. 1.

Firstly, the lower substrate 361*a* and elements provide thereon will be described below.

The lower substrate 361*a* may be an insulating substrate including transparent materials, such as glass or plastic.

The gate line GL and the gate electrode may be disposed on the lower substrate 361*a* . Although not illustrated, a connecting portion (e.g., an end portion) of the gate line GL may be larger than other portions thereof in size, so as to be properly connected to another layer or external driving circuits. The gate line GL may include at least one metal of aluminum (Al) or alloys thereof, silver (Ag) or alloys thereof, copper (Cu) or alloys thereof, and/or molybdenum (Mo) or alloys thereof. Further, the gate line GL may include one of chromium (Cr), tantalum (Ta), and titanium (Ti), but is not limited thereto. In some embodiments, the gate line GL may have a multi-layer structure including at least two conductive layers that have different physical properties.

The gate electrode GE may be provided in a shape protruding from the gate line GL. The gate electrode GE may be made of the same material and may have the same structure (a multi-layer structure) as in the gate line GL. In other words, the gate electrode GE and the gate line GL may be simultaneously formed in the same process.

The gate insulating layer 323 may be disposed on the gate line GL and the gate electrode GE. In this case, the gate insulating layer 323 may be formed over the entire surface of the lower substrate 361*a* including the gate line GL and the gate electrode GE. The gate insulating layer 323 may be made of, for example, silicon nitrides ($SiN_x$), silicon oxides ($SiO_x$), and the like. The gate insulating layer 323 may have a multi-layer structure including at least two insulating layers that have physical properties different from each other.

A semiconductor layer 313 may be disposed on the gate insulating layer 323. In this case, the semiconductor layer 313 may at least partially overlap the gate electrode GE. The semiconductor layer 313 may be made of amorphous silicon, polycrystalline silicon, or the like.

An ohmic contact layer 365 may be disposed on the semiconductor layer 313. The ohmic contact layer 365 may include n+hydrogenated amorphous silicon highly doped with n-type impurities, such as phosphorus, or silicide. The ohmic contact layer 365 may be disposed on the semiconductor layer 313 in pairs.

Source and drain electrodes SE and DE may be disposed on the ohmic contact layer 365.

The source electrode SE may branch off from the data line DL and may protrude toward the gate electrode GE. The source electrode SE may at least partially overlap the semiconductor layer 313 and the gate electrode GE. The source electrode SE may have an inverted C-shape enclosing a part of the drain electrode DE. In some embodiments, the source electrode SE may have one of a C-shape, a U-shape, and an inverted U-shape, instead of the inverted C-shape.

In some embodiments, it is desirable that the source electrode SE is made of refractory metal, such as molybdenum, chromium, tantalum and titanium, or a metal alloy thereof. The source electrode SE may have a multi-layer structure including a refractory metal layer and a low-resistance conductive layer. Examples of the multi-layer structure may include a double-layer structure including a chromium or molybdenum (alloy) lower film and an aluminum (alloy) upper film; and a triple-layer structure including a molybdenum (alloy) lower film, an aluminum (alloy) intermediate film, and a molybdenum (alloy) upper film. Further, the source electrode SE may be formed of various metals or conductive materials rather than the aforementioned materials.

One side of the drain electrode DE may be connected to the pixel electrode 301. Another side of the drain electrode DE may at least partially overlap the semiconductor layer 313 and the gate electrode GE. The drain electrode DE may also include the same material and have the same structure (a multi-layer structure) as in the source electrode SE. In other words, the drain electrode DE and the source electrode SE may be simultaneously formed in the same process.

The gate, source, and drain electrodes GE, SE, and DE may together form a TFT along with the semiconductor layer 313. In this case, a channel of the TFT may be partially formed on the semiconductor layer 313 between the source and drain electrodes SE and DE.

The data line DL may be disposed on the gate insulating layer 323. Although not illustrated, the data line DL may have a connecting portion (e.g., an end portion) that is larger than other portions thereof in size, so as to be properly connected to another layer or external driving circuits.

The data line DL may transmit a data signal and may extend in its longitudinal direction to intersect the gate line GL. In this case, a center portion of each data line DL may be bent into a V-shape, so that the LCD device can achieve a greater transmittance. The data line DL may include the same material and have the same structure (a multi-layer structure) as in the source electrode SE. In other words, the data line DL and the source electrode SE may be simultaneously formed in the same process.

A first protection layer 324 may be disposed on the data line DL, the source electrode SE, and the drain electrode DE. In this case, the first protection layer 324 may be formed over the entire surface of the lower substrate 361*a* including the data line DL, the source electrode SE, and the drain electrode DE. The first protection layer 324 may be formed of, for example, inorganic insulating materials such as silicon nitrides ($SiN_x$) and silicon oxides ($SiO_x$). When the first protection layer 324 is made of an inorganic insulating material, an inorganic material having photosensitivity and a dielectric constant of about 4.0 may be used. The first protection layer 324 may also have a double-layer structure including a lower inorganic layer and an upper organic layer, which has been found to impart desirable insulating properties and also to prevent damage to exposed portions of the semiconductor layer 313. As examples, the first protection layer 324 may have a thickness of about 5000 Å or more and may be about 6000 Å to about 8000 Å.

A shielding electrode 370 may be disposed on the first protection layer 324. In this case, the shielding electrode 370 may overlap the data line DL. The shielding electrode 370 may block interference between a signal applied to the data line DL and a signal applied to the pixel electrode 301. A common voltage may be applied to the shielding electrode 370.

A color filter 366 may be disposed on the first protection layer 324 and the shielding electrode 370. Meanwhile, an edge portion of the color filter 366 may overlap an edge portion of another color filter disposed adjacent thereto.

A second protection layer 337 may be disposed on the color filter 366. In this case, the second protection layer 337 may be formed over the entire surface of the lower substrate 361*a* including the color filter 366. The second protection layer 337 may include materials used to form the first protection layer 324.

The pixel electrode 301 and the first dummy line 181 may be disposed on the second protection layer 337. In this case, the pixel electrode 301 may be disposed in the pixel region. The pixel electrode 301 may be connected to the drain electrode DE exposed through a contact hole 476 that extends through the second protection layer 337, the color filter 366, and the first protection layer 324 together. Meanwhile, although not illustrate in FIG. 3, the second dummy line 182 may also be disposed on the second protection layer 337.

The pixel electrode 301 may include transparent conductive materials such as indium tin oxide (ITO) or indium zinc oxide (IZO). In this case, ITO may be a polycrystalline or monocrystalline material, and IZO may be a polycrystalline or monocrystalline material, as well. Meanwhile, the first dummy line 181 and the second dummy line 182 may include the same materials as in the pixel electrode 301.

The first dummy line 181, as illustrated in FIG. 3, may be disposed corresponding to the black matrix 342. In detail, the first dummy line 181 may be disposed to correspond to an area where the black matrix 342 on the upper substrate 361*b* , the data line DL on the lower substrate 361*a* , and the shielding electrode 370 on the lower substrate 361*b* overlap each other.

Meanwhile, although not illustrated in FIG. 3, the second dummy line 182 may be disposed on the second protection layer 337, corresponding to another shielding electrode 370.

From the foregoing, it will be appreciated that various embodiments in accordance with the present disclosure have been described herein for purposes of illustration, and that various modifications may be made without departing from the scope and spirit of the present teachings. Accordingly, the various embodiments disclosed herein are not intended to be limiting of the true scope and spirit of the present teachings. Various features of the above described and other embodiments can be mixed and matched in any manner, to produce further embodiments consistent with the invention.

What is claimed is:

1. A display device comprising:

a display panel comprising a gate line, a data line, a first dummy line, and a second dummy line;

a first data driver integrated circuit connected to one side of the data line;

a second data driver integrated circuit connected to another side of the data line;

a first power supply configured to apply a part of first enable signals to the first data driver integrated circuit, and to apply a part of second enable signals to the second data driver integrated circuit through the second dummy line; and a second power supply configured to apply a remaining part of the second enable signals to the second data driver integrated circuit, and to apply a remaining part of the first enable signals to the first data driver integrated circuit through the first dummy line.

2. The display device of claim 1, wherein the first and second dummy lines are parallel to the data line.

3. The display device of claim 1, further comprising a first carrier mounted with the first data driver integrated circuit, the first data driver integrated circuit being connected to the first dummy line through a dummy terminal of the first carrier.

4. The display device of claim 1, further comprising a second carrier mounted with the second data driver integrated circuit, the second data driver integrated circuit being connected to the second dummy line through a dummy terminal of the second carrier.

5. The display device of claim 1, further comprising:

a first control printed circuit board mounted with the first power supply; and a first source printed circuit board, one side of the first source printed circuit board being connected to the first control printed circuit board and another side thereof being connected to the first data driver integrated circuit.

6. The display device of claim 3, further comprising:

a second control printed circuit board mounted with the second power supply; and a second source printed circuit board, one side of the second source printed circuit board being connected to the second control printed circuit board and another side thereof being connected to the second data driver integrated circuit.

7. The display device of claim 1, wherein the first enable signals comprise a plurality of driving voltages having different voltage levels.

8. The display device of claim 7, wherein the second power supply applies a driving voltage of the plurality of driving voltages to the first data driver integrated circuit through the first dummy line.

9. The display device of claim 8, wherein the applied driving voltage has a smallest voltage level of those of the plurality of driving voltages.

10. The display device of claim 8, wherein the second power supply applies, to the second data driver integrated circuit, the rest of the driving voltages except for the applied driving voltage.

11. The display device of claim 1, wherein the second enable signals comprise a plurality of driving voltages having different voltage levels.

12. The display device of claim 11, wherein the first power supply applies a driving voltage of the plurality of driving voltages to the second data driver integrated circuit through the second dummy line.

13. The display device of claim 12, wherein the applied driving voltage has a smallest voltage level of those of the plurality of driving voltages.

14. The display device of claim 12, wherein the first power supply applies, to the first data driver integrated circuit, the rest of the driving voltages, except for the applied driving voltage.

15. The display device of claim 1, wherein the gate line and the data line intersect each other.

16. A display device comprising:

a display panel comprising a gate line and a data line;

a first data driver integrated circuit and a second data driver integrated circuit, both connected to and driving the data line;

first power supply connected to both the first and second data driver integrated circuits; and second power supply connected to both the first and second data driver integrated circuits;

wherein the first data driver integrated circuit is enabled by both the first and second power supplies, the second data driver integrated circuit is enabled by both the first and second power supplies.

* * * * *